US011211729B2

(12) United States Patent
Kubota et al.

(10) Patent No.: US 11,211,729 B2
(45) **Date of Patent: *Dec. 28, 2021**

(54) TERMINAL MATERIAL FOR CONNECTORS, TERMINAL, AND ELECTRIC WIRE TERMINATION STRUCTURE

(71) Applicant: MITSUBISHI MATERIALS CORPORATION, Tokyo (JP)

(72) Inventors: Kenji Kubota, Naka (JP); Yoshie Tarutani, Naka (JP); Kiyotaka Nakaya, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/481,624

(22) PCT Filed: Jan. 29, 2018

(86) PCT No.: PCT/JP2018/002642

§ 371 (c)(1),
(2) Date: Jul. 29, 2019

(87) PCT Pub. No.: WO2018/139628

PCT Pub. Date: Aug. 2, 2018

(65) Prior Publication Data

US 2019/0386415 A1 Dec. 19, 2019

(30) Foreign Application Priority Data

Jan. 30, 2017 (JP) ..... JP2017-014031

(51) Int. Cl.

| | |
|---|---|
| ***C25D 7/00*** | (2006.01) |
| ***C25D 5/10*** | (2006.01) |
| ***C25D 5/12*** | (2006.01) |
| ***C25D 5/50*** | (2006.01) |
| ***H01R 13/03*** | (2006.01) |

(Continued)

(52) U.S. Cl.
CPC ..... *H01R 13/03* (2013.01); *C25D 5/12* (2013.01); *C25D 7/00* (2013.01); *H01R 4/185* (2013.01); *H01R 4/62* (2013.01)

(58) Field of Classification Search
CPC .. C23F 15/00; C25D 7/00; C25D 5/12; C25D 7/0607; C22C 13/00; H01B 1/026;
(Continued)

(56) References Cited

U.S. PATENT DOCUMENTS 6,613,451 B1 * 9/2003 Asahara ..... C23C 28/021 428/647
2016/0064847 A1 * 3/2016 Gaertner ..... C23C 2/06 439/741

(Continued)

FOREIGN PATENT DOCUMENTS

CN 108352639 A 7/2018
EP 2722930 A1 4/2014

(Continued)

OTHER PUBLICATIONS

International Search Report dated Mar. 27, 2018, issued for PCT/JP2018/002642.

(Continued)

*Primary Examiner* — Daniel J. Schleis
*Assistant Examiner* — Kevin CT Li
(74) *Attorney, Agent, or Firm* — Locke Lord LLP; James E. Armstrong, IV; Nicholas J. DiCeglie, Jr.

(57) ABSTRACT

A terminal material for a connector terminal, using a copper or copper alloy substrate is crimped to an end of wire formed from an aluminum wire material; and a terminal using this terminal material: a zinc layer 4 that is formed of zinc or a zinc alloy and a tin layer 5 that is formed of tin or a tin alloy are sequentially laminated in this order on a substrate 2 that is formed of copper or a copper alloy: with respect to the (Continued)

zinc layer and the tin layer, the adhesion amount of tin contained in the whole layers is from 0.5 mg/cm$^2$ to 7.0 mg/cm$^2$ (inclusive) and the adhesion amount of zinc contained in the whole layers is from 0.07 mg/cm$^2$ to 2.0 mg/cm$^2$ (inclusive), and the content percentage of zinc in the vicinity of the surface is from 0.2% by mass to 10.0% by mass (inclusive).

7 Claims, 2 Drawing Sheets

(51) Int. Cl.
*H01R 4/18* (2006.01)
*H01R 4/62* (2006.01)

(58) Field of Classification Search
CPC . H01B 1/023; H01B 7/00; H01R 4/62; H01R 4/18; H01R 13/03
See application file for complete search history.

(56) References Cited

U.S. PATENT DOCUMENTS

| | | | | |
|---|---|---|---|---|
| 2019/0161866 | A1* | 5/2019 | Kubota | C25D 7/00 |
| 2020/0259274 | A1 | 8/2020 | Kubota et al. | |

FOREIGN PATENT DOCUMENTS

| | | | | |
|---|---|---|---|---|
| EP | 3012919 | A1 | | 4/2016 |
| EP | 3382814 | A1 | | 10/2018 |
| EP | 3392382 | A1 | | 10/2018 |
| JP | H01-259195 | A | | 10/1989 |
| JP | 2002-115093 | A | | 4/2002 |
| JP | 2008-285729 | A | | 11/2008 |
| JP | 2009-084616 | A | | 4/2009 |
| JP | 2009084616 | A | * | 4/2009 |
| JP | 2010-168666 | A | | 8/2010 |
| JP | 2013-218866 | A | | 10/2013 |
| JP | 2015-133306 | A | | 7/2015 |
| JP | 2016-169439 | A | | 9/2016 |
| JP | 2017-203214 | A | | 11/2017 |

OTHER PUBLICATIONS

Extended European Search Report issued in corresponding European Patent Application No. EP 18744268.6, dated Nov. 6, 2020.
Office Action issued in corresponding Chinese Patent Application No. CN 201880008244.0, dated Dec. 14, 2020.

* cited by examiner

TERMINAL MATERIAL FOR CONNECTORS, TERMINAL, AND ELECTRIC WIRE TERMINATION STRUCTURE

BACKGROUND OF THE INVENTION

Technical Field

The present invention is used for a terminal for connectors that is crimped to a terminal end of an electric wire made of an aluminum wire material; and relates to a terminal material plated with tin or tin alloy on a surface of a substrate made of copper or copper alloy, a terminal made of the terminal material and an electric wire termination structure using the terminal.

Priority is claimed on Japanese Patent Application No. 2017-14031, filed Jan. 30, 2017, the content of which is incorporated herein by reference.

Background Art

Conventionally, a terminal end of an electric wire formed from copper or copper alloy is crimped with a terminal formed from copper or copper alloy; and the terminal is connected to a terminal of another equipment, so that the electric wire is connected to that equipment. In order to reduce a weight of the electric wires and so forth, there is a case in which the electric wires are formed from aluminum or aluminum alloy instead of copper or copper alloy.

For example, Patent Document 1 discloses an electric wire with terminals in which a terminal made of copper or copper alloy with tin plating is crimped to an electric wire made of aluminum or aluminum alloy, as an electric wire with terminals installed on vehicles such as automobiles.

Forming the electric wire (a conducting wire) from aluminum or aluminum alloy and forming the terminal from copper or copper alloy, there is a case in which electrical corrosion may be occurred owing to a potential difference between different metals if water moves into a crimp part between the terminal and the electric wire. Furthermore, there is a case in which an electrical resistivity be increased or a crimping forth be decreased in the crimp part with the corrosion of the electric wire.

For preventing this corrosion, in Patent Document 1 for example, an anti-corrosion layer made of metal (zinc or zinc alloy) having sacrificial anti-corrosion property to a substrate layer is formed between the substrate layer and a tin layer.

An electrical contact material for connectors shown in Patent Document 2 has a substrate made of a metal material, an alloy layer formed on the substrate, and a conductive film layer formed on a surface of the alloy layer. The alloy layer essentially contains Sn (tin), and includes one or more additive elements M selected from Cu, Zn, Co, Ni and Pd. The conductive film layer including hydroxide oxide $Sn_3O_2(OH)_2$ and the like are known.

An Sn plating material disclosed in Patent Document 3 is known as an example of adding Zn to Sn. The Sn plating Material has an undercoat Ni plating layer, an intermediate Sn—Cu plating layer and a surface Sn plating layer on a surface of a copper or a copper alloy in this order: the undercoat Ni plating layer is formed from Ni or Ni alloy: the intermediate Sn—Cu plating layer is formed from an Sn—Cu type alloy in which at least an Sn—Cu—Zn alloy layer is formed at a side being in contact with the surface Sn plating layer: the surface Sn plating layer is formed from an Sn alloy including Zn 5 to 1000 ppm by mass: and a highly-concentrated Zn layer with a Zn concentration more than 0.2% by mass to 10% by mass on an outermost surface is further included.

CITATION LIST

Patent Documents

[Patent Document 1] Japanese Unexamined Patent Application, First Publication No. 2013-218866

[Patent Document 2] Japanese Unexamined Patent Application, First Publication No. 2015-133306

[Patent Document 3] Japanese Unexamined Patent Application, First Publication No. 2008-285729

SUMMARY OF INVENTION

Technical Problem

However, if the anti-corrosion layer formed from zinc or zinc alloy is provided as the undercoat as in Patent Document 1, there is a problem in which adhesion property between the anti-corrosion layer and the Sn plating is deteriorated because Sn substitution is occurred by performing Sn plating on the anti-corrosion layer.

Even in a case in which a hydroxide oxide layer of $Sn_3O_2(OH)_2$ is provided as in Patent Document 2, there is a problem in which durability is low since the hydroxide oxide layer defects immediately when being exposed in a corrosion environment or heating environment. If an Sn—Zn alloy layer is layered on an Sn—Cu type alloy layer and a zinc highly-concentrated layer is provided on an outermost layer as in Patent Document 3, there is a problem of productivity of Sn—Zn alloy plating being low, and also anti-corrosion effect of an aluminum wire material cannot be obtained in a case in which copper of the Sn—Cu alloy layer is exposed on an surface layer.

As a contact material used for connectors, contact resistance is required to be reduced, and it is necessary to reduce an increase of contact resistance particularly when sliding wear is occurred.

The present invention is achieved in consideration of the above circumstances, and has an object to provide a terminal material for connectors, a terminal made of the terminal material, and an electric wire termination structure using the terminal, in which a substrate formed from copper or copper alloy is used for the terminal crimped to the terminal end of the electric wire formed from an aluminum wire material so electrical corrosion can be efficiently reduced and also contact resistance is low.

Solution to Problem

A terminal material for connectors according to the present invention includes a substrate made of copper or copper alloy, and a zinc layer made of zinc alloy and a tin layer made of tin alloy layered on the substrate in this order: in the zinc layer and the tin layer, an adhesion amount of tin contained in a whole is not less than 0.5 $mg/cm^2$ and not more than 7.0 $mg/cm^2$, an adhesion amount of zinc contained in the whole is not less than 0.07 $mg/cm^2$ and not more than 2.0 $mg/cm^2$, and a zinc content percentage in a vicinity of a surface is not less than 0.2% by mass and not more than 10.0% by mass.

In this terminal material for connectors, under the tin layer at the surface layer, the zinc layer having a corrosion potential nearer to that of aluminum than that of tin is formed, and zinc is contained in a vicinity of a surface: so that an effect of preventing corrosion of an aluminum wire is high.

In this case, if the adhesion amount of tin contained in the whole zinc layer and tin layer is less than 0.5 mg/cm$^2$, some of zinc is exposed while working, and the contact resistance is increased. If the adhesion amount of tin exceeds 7.0 mg/cm$^2$, zinc is not sufficiently diffused to the surface, so that the corrosion current value is increased. An appropriate range of the adhesion amount of tin is 0.7 mg/cm$^2$ to 2.0 mg/cm$^2$ (inclusive).

If the adhesion amount of zinc is less than 0.07 mg/cm$^2$, zinc is not sufficiently diffused to the surface of the tin layer, and the corrosion current value is increased. If the adhesion amount of zinc exceeds 2.0 mg/cm$^2$, zinc is excessively diffused and the contact resistance is increased. An appropriate range of the adhesion amount of zinc is 0.2 mg/cm$^2$ to 1.0 mg/cm$^2$ (inclusive).

If the zinc content percentage in the vicinity of the surface exceeds 10.0% by mass, a large amount of zinc is exposed from the surface and the contact resistance is deteriorated. If the zinc content percentage is less than 0.2% by mass in the vicinity of the surface, anti-corrosion effect is not sufficient. The zinc content percentage is preferably 0.4% by mass to 5.0% by mass (inclusive).

As a desired embodiment of the terminal material for connectors of the present invention, it is preferable that a corrosion potential to a silver-silver chloride be not more than −500 mV and not less than −900 mV.

It is possible to reduce the corrosion current low and have an excellent anti corrosion effect.

As an appropriate embodiment of the terminal material for connectors of the present invention, it is preferable that at least one of the tin layer and the zinc layer contains one or more of nickel, iron, manganese, molybdenum, cobalt, cadmium and lead as an additive element and an adhesion amount thereof is not less than 0.01 mg/cm$^2$ and not more than 0.3 mg/cm$^2$.

Containing these additives, zinc is prevented from excessive diffusion, and there is an effect of reducing generation of whiskers. If the adhesion amount thereof is less than 0.01 mg/cm$^2$, zinc is excessively diffused to the surface of tin, so that the contact resistance is increased and the effect of reducing the whiskers is decreased. If the adhesion amount exceeds 0.3 mg/cm$^2$, zinc is not sufficiently diffused, and the corrosion current is increased.

As an appropriate embodiment of the terminal material for connectors of the present invention, it is preferable that the adhesion amount of the zinc be not less than one times and not more than 10 times of the adhesion amount of the additive element.

These adhesion amounts have relations in this range, so that the generation of the whiskers is further prevented.

As an appropriate embodiment of the terminal material for connectors of the present invention, it is preferable that a ground layer made of nickel or nickel alloy be formed between the substrate and the zinc layer; and the ground layer have a thickness not less than 0.1 μm and not more than 5 μm and a nickel content percentage not less than 80% by mass.

The ground layer between the substrate and the zinc layer has functions of improving adhesion between them and preventing diffusion of copper to the zinc layer and the tin layer from the substrate made of copper or copper alloy. If the thickness of the ground layer is less than 0.1 μm, the effect of preventing copper from diffusion is poor; if it exceeds 5.0 μm, breakages may be easily occurred while the press working. If the nickel content percentage is less than 80% by mass, the effect of preventing diffusion of copper to the zinc layer and the tin layer is poor.

As an appropriate embodiment of the terminal material for connectors of the present invention, it is formed to be a belt sheet shape, and in a carrier part along a length direction thereof, terminal members formed to be terminals by a press working are coupled to the carrier part with intervals along a length direction of the carrier part.

A terminal of the present invention is a terminal formed from the above mentioned terminal material for connectors: and in an electric wire termination structure of the present invention the terminal is crimped to an end of an electric wire made of aluminum or aluminum alloy.

There is a case in which the zinc layer and the tin layer cannot clearly recognized because of mutual diffusion. The terminal material for connectors in this case includes a substrate made of copper or copper alloy, and a tin zinc layer containing zinc and tin layered on the substrate; in the tin zinc layer, an adhesion amount of tin contained in a whole thereof is not less than 0.5 mg/cm$^2$ and not more than 7.0 mg/cm$^2$, an adhesion amount of zinc is not less than 0.07 mg/cm$^2$ and not more than 2.0 mg/cm$^2$, and a zinc content percentage is not less than 0.2% by mass and not more than 10% by mass in a vicinity of a surface.

Advantageous Effects of Invention

According to the terminal material for connectors of the present invention, because the zinc layer and the tin layer is formed on the substrate and zinc is contained in the vicinity of the surface, the anti-corrosion effect against the electric wire made of aluminum is improved: because the zinc layer is formed between the tin layer and the substrate, it is possible to prevent an increase of the electrical resistivity and deterioration of the adhesion by preventing the electrical corrosion with the aluminum-made electric wire even when the tin layer is disappeared. Furthermore, it is possible to reduce also the rise of the contact resistance when it is worn by sliding.

DESCRIPTION OF EMBODIMENTS

A terminal material for connectors, a terminal, and an electric wire termination structure of an embodiment according to the present invention will be explained.

Figure 2:
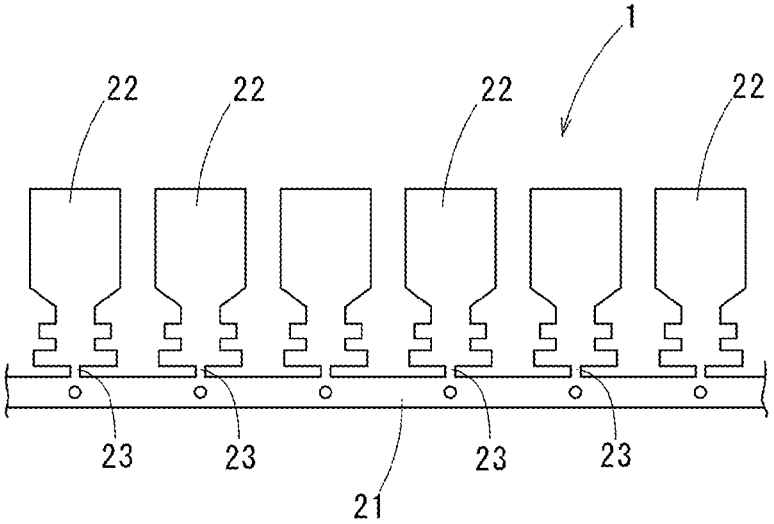
FIG. 2 It is a plan view of the terminal material of the embodiment.

A terminal material for connectors 1 of the present embodiment is a strip material formed to be a belt sheet shape for forming terminals as a whole thereof is shown in FIG. 2: on a carrier part 21 along a longitudinal direction, terminal members 22 formed to be terminals are arranged in a longitudinal direction of the carrier part 21 with intervals: and the respective terminal members 22 are coupled to the carrier part 21 with narrow width coupling parts 23 therebetween. The terminal members 22 are formed to have a shape of a terminal 10 shown in FIG. 3 for example, and finished as the terminals 10 by being cut off from the coupling parts 23.

Figure 3:
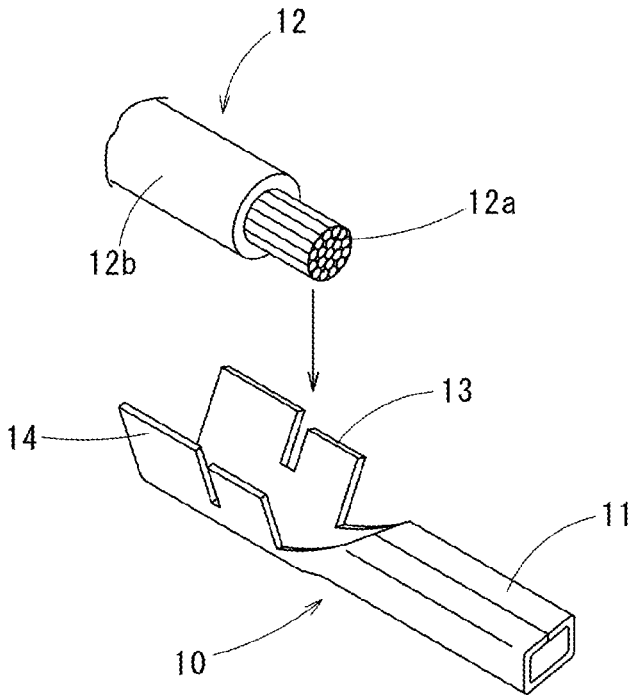
FIG. 3 It is a perspective view showing an example of a terminal on which the terminal material of the embodiment is applied.

The terminal 10 is shown as a female terminal in an example of FIG. 3, having a connecting part 11 to which a male terminal (not illustrated) is fit inserted, a core wire crimp part 13 to which an exposed core wire 12*a* of an electric wire 12 is crimped, and a cover crimp part 14 to which a cover part 12*b* of the electric wire 12 is crimped are integrally formed in this order from a tip end.

Figure 4:
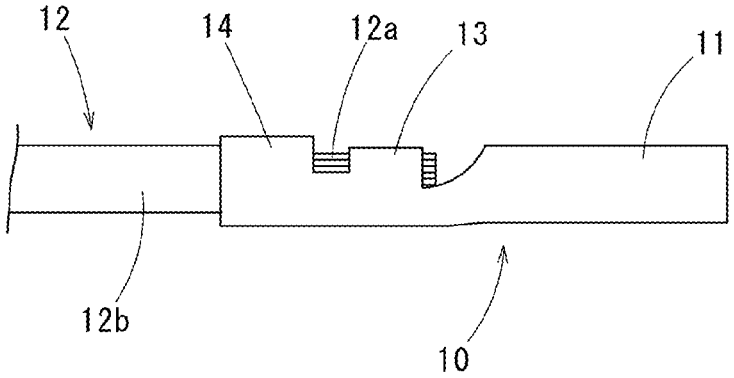
FIG. 4 It is a frontal view showing a terminal end of an electric wire to which the terminal of FIG. 3 is crimped.

FIG. 4 shows a termination structure in which the terminal 10 is crimped to the electric wire 12: the core wire crimp part 13 is directly in contact with the core wire 12*a* of the electric wire 12.

Figure 1:
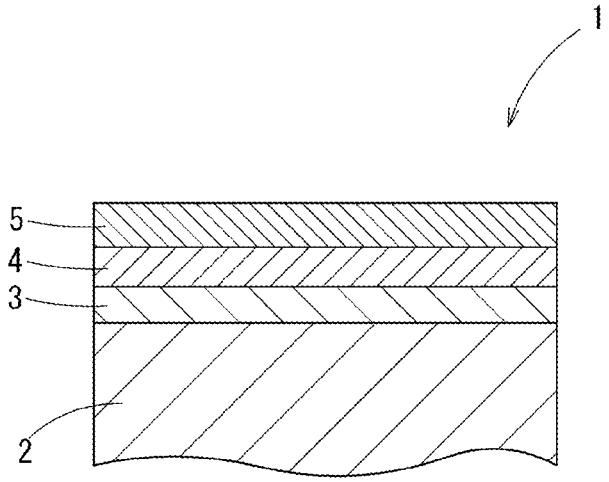
FIG. 1 It is a sectional view schematically showing an embodiment of a terminal material for connectors of the present invention.

In this terminal material for connectors 1, as schematically showing a section thereof in FIG. 1, an ground layer 3 formed of nickel or nickel alloy, a zinc layer 4 formed of zinc alloy, and a tin layer 5 formed of tin alloy are layered on a substrate 2 in this order.

A composition of the substrate 2 is not particularly limited but formed from copper or a copper alloy.

The ground layer 3 has a thickness 0.1 μm to 5.0 μm (inclusive) and a nickel content percentage 80% by mass or more. The ground layer 3 improve adhesion between the substrate 2 and the zinc layer 4 and prevent diffusion of copper from the substrate 2 to the zinc layer 4 and the tin layer 5: if the thickness thereof is less than 0.1 μm, an effect of preventing the diffusion of copper is poor; if it exceeds 5.0 μm, breakages are easy to be occurred while a pressing work. It is more preferable that the thickness of the ground layer 3 be 0.3 μm to 2.0 μm (inclusive).

If the nickel content percentage is less than 80% by mass, the effect of preventing diffusion of the copper to the zinc layer 4 and the tin layer 5 is poor. The nickel content is preferably 90% by mass or more.

Tin and zinc are diffused into the zinc layer 4 and the tin layer 5 mutually: an adhesion amount of the tin is 0.5 $mg/cm^2$ to 7.0 $mg/cm^2$ (inclusive) and an adhesion amount of the zinc is 0.07 $mg/cm^2$ to 2.0 $mg/cm^2$ (inclusive), which are contained in the whole (the whole between an interface to the ground layer 3 and the outermost surface).

When the adhesion amount of the tin is less than 0.5 $mg/cm^2$, some of zinc is exposed while working, so that the contact resistance is increased. When the adhesion amount of tin exceeds 7.0 $mg/cm^2$, zinc is not sufficiently diffused to the surface, so that a corrosion current value is increased. An appropriate range of the adhesion amount of tin is 0.7 $mg/cm^2$ to 2.0 $mg/cm^2$ (inclusive).

When the adhesion amount of zinc is less than 0.07 $mg/cm^2$, zinc is not sufficiently diffused to the surface of the tin layer 5, so that the corrosion current value is increased. When the adhesion amount of zinc exceeds 2.0 $mg/cm^2$, zinc is excessively diffused, so that the contact resistance is increased. An appropriate range of the adhesion amount of zinc is 0.2 $mg/cm^2$ to 1.0 $mg/cm^2$ (inclusive).

The adhesion amount means a content per a unit area ($mg/cm^2$) in the whole of the zinc layer 4 and the tin layer 5.

In this case, a zinc content percentage in the vicinity of a surface is 0.2% by mass to 10.0% by mass (inclusive). When it exceeds 10.0% by mass, a large amount of zinc is exposed from the surface, so that the contact resistance is deteriorated. When the zinc content percentage in the vicinity of the surface is less than 0.2% by mass, the anti-corrosion effect is not sufficient. The zinc content percentage is preferably 0.4% by mass to 5.0% by mass (inclusive). In this case, the vicinity of the surface means a range of a depth 0.3 μm from the surface of the whole film.

It is preferable that a thickness of the zinc layer 4 be 0.1 μm to 2.0 μm (inclusive), and a thickness of the tin layer 5 be 0.2 μm to 5.0 μm (inclusive). Since the zinc layer 4 and the tin layer 5 are mutually diffused, there is a case in which an interface between the zinc layer 4 and the tin layer 5 is difficult to be recognized: moreover, there is a case in which the zinc layer 4 and the tin layer 5 cannot be clearly recognized but can be a film recognized as a tin zinc layer containing zinc and tin, in accordance with the respective thicknesses and an extent of mutual diffusion.

At least one of the tin layer 5 and the zinc layer 4 contains one or more of nickel, iron, manganese, molybdenum, cobalt, cadmium, and lead as an additive element: an adhesion amount thereof is preferably 0.01 $mg/cm^2$ to 0.3 $mg/cm^2$ (inclusive). As below-mentioned, the zinc layer 4 contains these additive elements in the embodiment. In a case in which it is the tin zinc layer, it is enough that the whole thereof contains the above-mentioned additive element.

Containing these additives, it is effective for restrain the excessive diffusion of zinc and generation of whiskers. When the adhesion amount thereof is less than 0.01 $mg/cm^2$, zinc is excessively diffused to the surface of tin, so that the contact resistance is increased and the effect of restraining the whisker is poor. If the adhesion amount exceeds 0.3 $mg/cm^2$, zinc is not sufficiently diffused and the corrosion current is increased.

The above mentioned adhesion amount of zinc is desirable in a range not less than 1 times and not more than 10 times of the adhesion amount of these additive elements. By a relation in this range, the whiskers are more prevented from generating.

The terminal material for connecters 1 having the above structure has an excellent anti-corrosion effect, since the corrosion potential to a silver-silver chloride electrode is not more than −500 mV and not less than −900 mV (−500 mV to −900 mV) and a corrosion potential of aluminum is not more than 700 mV and not less than −900 mV.

Subsequently, a manufacturing method of the terminal material for connectors 1 will be explained.

A sheet material made of copper or copper alloy is prepared as the substrate 2. Performing a cutting work, a punching work and the like on this sheet material, a strip material in which terminal members 22 are coupled with the carrier part 21 with the coupling parts 23 therebetween as shown in FIG. 2 is formed. Then, after cleaning surfaces of this strip material by performing treatments of a degreasing, a pickling and the like, a nickel or nickel plating treatment for forming the ground layer 3, a zinc or zinc alloy plating treatment for forming the zinc layer 4, and a tin or tin alloy plating treatment for forming the tin layer 5 are performed in this order.

The nickel or nickel alloy plating for forming the ground layer 3 is not limited if a dense film with mainly containing nickel can be obtained: it can be formed by electroplating using a known Watts bath, a sulfamic acid bath, a citric acid bath or the like. For nickel alloy plating, a nickel tungsten (Ni—W) alloy, a nickel phosphorous (N—P) alloy, a nickel cobalt (Ni—Co) alloy, a nickel chromium (Ni—Cr) alloy, a nickel iron (Ni—Fe) alloy, a nickel zinc (Ni—Zn) alloy, a nickel boron (Ni—B) alloy and the like can be used.

Considering the terminal 10 in a press bending property and a barrier property against copper, a pure nickel plating obtained by the sulfamic acid bath is appropriate.

The zinc or zinc alloy plating for forming the zinc layer 4 is not specifically limited if a dense film can be obtained with a prescribed composition: a known sulfate bath, a chloride bath, a zincate bath or the like can be used for the zinc plating. For zinc alloy plating, the sulfate bath, the chloride bath, an alkaline bath can be used for zinc-nickel alloy plating; or a complexing agent bath containing a citric acid and the like can be used for tin-zinc alloy plating. A film of zinc cobalt alloy plating can be formed using the sulfate bath: a film of zinc-manganese alloy plating can be formed using a sulfate bath containing citric acid: and a film of zinc-molybdenum plating can be formed using the sulfate bath.

Tin or tin alloy plating for forming the tin layer 5 can be performed by known methods: i.e., electroplating can be performed using an organic acid bath (i.e., a phenol sulfonic acid bath, an alkane sulfonic acid bath, or an alkanol sulfonic acid bath), an acidic bath such as a fluoboric acid bath, a halogen bath, a sulfuric acid bath, a pyrophosphoric acid bath and the like, or an alkaline bath such as a potassium bath, a sodium bath or the like.

As explained above, the nickel or nickel alloy plating, the zinc plating or the zinc alloy plating, and the tin or tin alloy plating are performed in this order on the substrate 2, and then the heat treatment is performed.

In this heat treatment, it is heated so that a surface temperature of an object is 30° C. to 190° C. (inclusive). By this heat treatment, zinc in a zinc plating or zinc alloy plating layer is diffused into a tin plating layer. As zinc is rapidly diffused, it is enough to be exposed at temperature 30° C. or higher for 24 hours or longer. However, it is not heated to temperature higher than 190° C., because zinc alloy repels melted tin and forms parts where tin is repelled on the tin layer 5.

In the terminal material for connectors 1 manufactured as above, as a whole, the ground layer 3 formed of nickel or nickel alloy, the zinc layer 4 formed of zinc or zinc alloy, and the tin layer 5 are laminated on the substrate 2 in this order. Alternatively, as described above, the tin zinc layer in which the zinc layer 4 and the tin layer 5 are integrated is formed.

Then, the shape of the terminal 10 shown in FIG. 3 is formed by a pressing work and the like as it remains the strip material: and cutting the coupling parts 23, the terminals 10 are formed.

FIG. 4 shows a termination structure in which the electric wire 12 is crimped on the terminal 10: the core wire crimp part 13 is in directly contact with the core wire 12*a* of the electric wire 12.

This terminal 10 is effective to prevent the corrosion of the aluminum wire and can effectively prevent electric erosion, even in a state in which it is crimped to the aluminum core wire 12*a*; because the tin layer 5 contains zinc having nearer corrosion potential to aluminum than that of tin.

Since the plating treatment and the heat treatment were performed in the state of the strip material of FIG. 2, the substrate 2 is not exposed even at end surfaces of the terminal 10, so it is possible to show an excellent anti-corrosion effect.

Moreover, the zinc layer 4 is formed under the tin layer 5: even if all or a part of the tin layer 5 is lost by abrasion and the like at the worst, since the zinc layer 4 thereunder has the nearer corrosion potential to that of aluminum, it is possible to reliably prevent the electric erosion. Also when it is the integrated film as the tin zinc layer, the electric erosion can be prevented since zinc is contained in the vicinity of the surface: and since the zinc content is high in the vicinity of the interface to the ground layer 3, even if sliding wear and the like is occurred, it is effectively prevented by the zinc in the high concentration part to occur the electric erosion.

Furthermore, it is possible to prevent also the contact resistance from rising owing to the sliding wear as a connector.

The present invention is not limited to the above-described embodiment(s) and various modifications may be made without departing from the scope of the present invention.

Examples

Using a copper sheet of C1020 (oxygen free copper) of JIS standard as the substrate, degreasing and pickling it, and then nickel plating, zinc plating or zinc alloy plating and tin plating as the ground layer were performed in this order. Principal conditions of plating are as follows: the zinc content percentage in the zinc layer was controlled by varying a proportion of zinc ion and additive alloy element ion in the plating solution. Plating condition of zinc nickel alloy mentioned below is an example in which the zinc content is 15% by mass. In Sample 17, zinc or zinc alloy plating was not performed, the copper sheet was degreased and pickled, and nickel plating and tin plating were performed sequentially. In Samples 1 to 12, 17 and 19, nickel plating as the ground layer was not performed. As a sample in which the nickel alloy plating was performed on the ground layer, in Sample 14 nickel-phosphorus plating was performed. In Sample 3 to 16, elements described in Table 1 were added when the zinc alloy plating was performed.

—Condition of Nickel Plating—
Composition of Plating Bath
Nickel Sulfamate: 300 g/L
Nickel Chloride: 5 g/L
Boric Acid: 30 g/L
Bath Temperature: 45° C.
Current Density: 5 A/dm$^2$
—Condition of Zinc Plating—
Zinc Sulfate Heptahydrate: 250 g/L
Sodium Sulfate: 150 g/L
pH=1.2
Bath Temperature: 45° C.
Current Density: 5 A/dm$^2$
—Condition of Nickel Zinc Alloy Plating—
Composition of Plating Bath
Zinc Sulfate Heptahydrate: 75 g/L
Nickel Sulfate Hexahydrate: 180 g/L
Sodium Sulfate: 140 g/L
pH=2.0
Bath Temperature: 45° C.
Current Density: 5 A/dm$^2$
—Condition of Tin Zinc Alloy Plating—
Composition of Plating Bath
Tin (II) Sulfate: 40 g/L
Zinc Sulfate Heptahydrate: 5 g/L
Trisodium Citrate: 65 g/L
Nonionic Surfactant: 1 g/L
pH=5.0
Bath Temperature: 25° C.
Current Density: 3 A/dm$^2$
—Condition of Zinc Manganese Alloy Plating—
Composition of Plating Bath
Manganese Sulfate Monohydrate: 110 g/L
Zinc Sulfate Heptahydrate: 50 g/L
Trisodium Citrate: 250 g/L pH=5.3
Bath Temperature: 30° C.
Current Density: 5 A/dm$^2$
—Condition of Tin Plating—
Composition of Plating Bath
Methanesulfonic Acid Tin: 200 g/L
Methanesulfonic Acid: 100 g/L
Bath Temperature: 35° C.
Current Density: 5 A/dm$^2$ On the plated copper sheets, the heat treatment was performed at temperature 30° C. to 190° C. for in a range of 1 hour to 36 hours to make the samples.

With respect to the obtained samples, respectively measured were the thickness of the ground layer, the nickel content in the ground layer, the adhesion amounts of tin in the zinc layer and the tin layer, the adhesion amount of zinc in the zinc layer and the tin layer, the zinc content percentage in the zinc layer and the tin layer in the vicinity of the surface, and the adhesion amount of the additive elements other than tin and zinc in the zinc layer and the tin layer.

The thickness of the ground layer was measured by observing a section with a scanning ion microscope.

The nickel content percentage in the ground layer was measured as follows: forming observation samples by thinning samples to 100 nm or less with a focused ion beam device FIB (model No. SMI3050TB) made by Seiko Instrument Inc.; observing the observation samples with a scanning transmission electron microscope STEM (model No. JEM-2010F) made by JEOL Ltd. (formerly called Japan Electron Optics Laboratory Co., LTD) at an acceleration voltage 200 kV; and measuring by an energy dispersive X-ray spectrometer EDS (made by Thermo) belonging to the STEM.

The adhesion amounts of tin, the adhesion amount of zinc, and the adhesion amount of the other additive elements were measured in the zinc layer and the tin layer as follows. Masking the terminal material so that an area is known, it is soaked in a prescribed amount of plating stripping solution (Stripper L-80) made by Leybold Co., Ltd. so as to melt the tin layer and the zinc layer. Diluting this solution with dilute hydrochloric acid in a measuring flask to a prescribed amount; measuring density of element in the solution with a frame atom light absorption photometer; and dividing the density by the measuring area: and it was calculated. Using the above-mentioned plating stripping solution, it is possible to measure the element amount contained in the zinc layer and the tin layer without melting the substrate and the nickel plating layer.

The content percentage of zinc in the vicinity of the surface was measured at the surface of the samples using an electron probe micro analyzer EPMA (model No. JXA-8530F) made by JEOL Ltd. at an acceleration voltage 6.5 V and a beam diameter 30 μm. Because the acceleration voltage is low as 6.5 kV for this measurement, measured is the zinc content percentage in a depth about 0.3 μm from the surface of the tin layer.

Regarding the corrosion potential: cutting the sample 10 mm×50 mm, coating copper exposed parts such as the end surfaces with epoxy resin, then soaking in a sodium chloride solution 23° C. and 5% by mass: and the corrosion potential was obtained as an average value of measuring for 24 hours with 1 minute intervals using a function of measuring a spontaneous-potential of HA1510 made by Hokuto Denko Corporation, with a reference electrode that is a silver-silver chloride electrode (Ag/AgCl electrode) for a double-junction system made by Metrohm AG, in which a saturated potassium chloride solution is filled as an internal tube fluid.

The measurement results are shown in Table 1.

TABLE 1

| | GROUND LAYER | | TIN LAYER AND ZINC LAYER | | | | |
|---|---|---|---|---|---|---|---|
| | | | ADHESION AMOUNT | | Zinc Content Percentage in Vicinity of Surface | Adhesion Amount of Additional Element | Corrosion Potential |
| Sample No. | THICKNESS (μm) | Ni Content Percentage (%) | TIN (mg/cm$^2$) | ZINC (mg/cm$^2$) | (% by mass) | (mg/cm$^2$) | (mV vs. Ag/AgCl) |
| 1 | 0 | — | 0.5 | 2 | 10 | — | −940 |
| 2 | 0 | — | 7 | 0.07 | 0.2 | — | −490 |
| 3 | 0 | — | 6.5 | 0.1 | 0.4 | 0.4 (Co) | −510 |
| 4 | 0 | — | 0.8 | 1.9 | 5 | 0.007 (Pb) | −890 |
| 5 | 0 | — | 2 | 0.2 | 1.2 | 0.25 (Ni) | −520 |
| 6 | 0 | — | 2 | 0.2 | 0.9 | 0.3 (Fe) | −540 |
| 7 | 0 | — | 2 | 0.2 | 3.1 | 0.015 (Mn) | −750 |
| 8 | 0 | — | 2 | 0.2 | 2.1 | 0.01 (Mo) | −730 |
| 9 | 0 | — | 2 | 0.2 | 1.1 | 0.25 (Co) | −590 |
| 10 | 0 | — | 2 | 0.2 | 1.8 | 0.3 (Cd) | −550 |
| 11 | 0 | — | 2 | 0.2 | 2.5 | 0.01 (Pb) | −800 |
| 12 | 0 | — | 2 | 0.2 | 1.1 | 0.2 (Fe) | −580 |
| 13 | 0.05 | 100 | 2 | 0.2 | 1.9 | 0.02 (Ni) | −710 |
| 14 | 0.1 | 90 (Ni—P) | 1.5 | 0.5 | 1.3 | 0.07 (Ni) | −680 |
| 15 | 5 | 100 | 1.5 | 0.5 | 1.1 | 0.07 (Ni) | −690 |
| 16 | 0.5 | 100 | 1.5 | 0.5 | 1.2 | 0.07 (Ni) | −670 |
| 17 | 0 | — | 1.5 | 0 | 0 | — | −420 |
| 18 | 5.6 | 70 (Ni—Fe) | 0.4 | 2.2 | 12 | — | −920 |
| 19 | 0 | — | 8 | 0.05 | 0.3 | — | −430 |

Regarding the obtained samples, measured and evaluated were the corrosion current, the bending workability, generation status of the whiskers, and the contact resistance.

—Corrosion Current—

Regarding the corrosion current, arranging a pure aluminum wire coated with resin other than an exposure part of a diameter 2 mm and a sample coated with resin other than an exposure part of a diameter 6 mm so that the exposure parts thereof face to each other with a distance 1 mm, the corrosion current was measured between the aluminum wire and the sample in salt water of 23° C. and 5% by mass. In order to measure the corrosion current, a zero shunt ammeter HA1510 made by Hokuto Denko Corporation was used: the corrosion currents between the sample after heating for 1 hour ate 150° C. and the sample before heating were compared. A mean current value for 1000 minutes and a mean current value further longer test was performed on for 1000 to 3000 minutes were compared.

—Bending Workability—

Regarding the bending workability, cutting a test piece to have a longitudinal direction along a rolling direction, and using a W-shaped bending test tool regulated in JISH3110, a bending work was performed with a load $9.8\times10^3$ N orthogonal to the rolling direction. Then, observation was performed with a stereoscopic microscope. Evaluation of the bending workability: a level was evaluated as "excellent" if a clear crack was not recognized in a bended part after the test; a level was evaluated as "good" even though some cracks were recognized, if an exposure by the cracks of a copper alloy base material was not recognized; and a level was evaluated as "bad" if the copper alloy base material was exposed by the cracks.

—Generation Status of Whiskers—

Regarding evaluation of the generation status of the whiskers: leaving a flat sheet sample cut into 1 $cm^2$ square for 1000 hours under condition of 55° C. and 95% RH (relative humidity), and observing 3 view fields by ×100 magnification with an electron microscope, a length of a longest whisker in that was measured. It was evaluated as "excellent" if no generation of whisker was recognized; it was evaluated as "good" even though the whiskers were generated but if the length thereof is less than 50 μm; it was evaluated as "fair" if the length of the whisker was not less than 50 μm and less than 100 μm; and it was evaluated as "bad" if the length of the whisker was 100 μm or more.

—Contact Resistance—

The measurement method of the contact resistance was in accordance with JCBA-T323: using a four-terminal contact-resistance test device (made by Yamasaki Seiki Research Institute, Inc. CRS-113-AU), the contact resistance was measured at a load 0.98 N on a sliding test (1 mm). The measurement was performed on a plating surface of the flat sheet sample.

These results are shown in Table 2.

TABLE 2

| Sample No. | CORROSION CURRENT (μA) Before Heating | After Heating | Bending Workability | Whiskers | Contact Resistance (mΩ) |
|---|---|---|---|---|---|
| 1 | 4.1 | 6.1 | GOOD | FAIR | 2.0 |
| 2 | 4.0 | 6.5 | GOOD | FAIR | 2.1 |
| 3 | 2.1 | 5.5 | GOOD | GOOD | 1.9 |
| 4 | 3.0 | 6.2 | GOOD | FAIR | 1.5 |
| 5 | 2.1 | 3.5 | GOOD | GOOD | 0.8 |
| 6 | 1.8 | 2.5 | GOOD | GOOD | 0.9 |
| 7 | 1.2 | 3.5 | GOOD | GOOD | 0.7 |
| 8 | 1.3 | 3.1 | GOOD | GOOD | 0.6 |
| 9 | 2.9 | 4.5 | GOOD | GOOD | 0.7 |
| 10 | 1.9 | 4.0 | GOOD | GOOD | 0.8 |
| 11 | 1.1 | 2.0 | GOOD | GOOD | 0.8 |
| 12 | 1.0 | 1.9 | GOOD | EXCELLENT | 0.9 |
| 13 | 1.1 | 1.8 | EXCELLENT | EXCELLENT | 0.8 |
| 14 | 0.9 | 1.1 | EXCELLENT | EXCELLENT | 0.5 |
| 15 | 0.8 | 0.9 | EXCELLENT | EXCELLENT | 0.5 |
| 16 | 0.8 | 1.2 | EXCELLENT | EXCELLENT | 0.5 |
| 17 | 8.5 | 8.5 | GOOD | BAD | 0.6 |
| 18 | 5.8 | 7.5 | BAD | BAD | 5.2 |
| 19 | 8.1 | 8.2 | BAD | BAD | 0.7 |

It can be recognized from the results shown in Table 2 that the corrosion current was low, the bending workability was good, the whiskers were not generated, or the length were short even if the whiskers were generated, and the contact resistance was low in Samples 1 to 16: in Samples 1 to 16, in the zinc layer and the tin layer, the adhesion amount of tin contained in the whole was 0.5 $mg/cm^2$ to 7.0 $mg/cm^2$ (inclusive), the adhesion amount of zinc was 0.07 $mg/cm^2$ to 2.0 $mg/cm^2$ (inclusive), and the zinc content percentage is 0.2% by mass to 10.0% by mass (inclusive) in the vicinity of the surface. Above all, in Samples 3 and Samples 5 to 16 containing one of additive elements of nickel, iron, manganese, molybdenum, cobalt, cadmium, and lead with 0.01 $mg/cm^2$ to 0.3 $mg/cm^2$ (inclusive), the generation of the whiskers was especially prevented. Because Samples 14 to 16 had the ground layer formed with the thickness 0.1 μm to 5.0 μm (inclusive) and the nickel content percentage 80% or more between the substrate and the zinc layer, Samples 14 to 16 had more excellent effect of preventing the electrical corrosion even after heating than Samples 1 to 15 without the ground layer.

Meanwhile, in Sample 17 of Comparative Example, the corrosion potential was high and the corrosion current was high because there was no zinc layer (i.e., zinc was not adhered). In Sample 18, the adhesion amount of tin was small, the adhesion amount of zinc was large, and the nickel content percentage in the ground layer was low: so that the corrosion current value was deteriorated and the bending workability was inferior after heating: the contact resistance was deteriorated because the zinc diffusion was excessive and the corrosion potential was not higher than −900 mV vs Ag/AgCl. In Sample 19, because the adhesion amount of tin was large and the adhesion amount of zinc was small, the corrosion current value was high, and cracks were generated when the bending work was performed.

INDUSTRIAL APPLICABILITY

This invention can be used as a terminal for connectors used for connecting electric wires in automobiles, consumer products and the like; especially, it can be used for a terminal crimped to a terminal end of electric wires made of aluminum wire material.

REFERENCE SIGNS LIST

1 Terminal material for connectors
2 Substrate
3 Ground layer
4 Zinc layer
5 Tin layer
10 Terminal
11 Connecting part
12 Electric wire
12*a* Core wire
12*b* Cover part
13 Core wire crimp part
14 Cover crimp part

The invention claimed is:

1. A terminal material for connectors comprising a substrate made of copper or copper alloy, and a zinc layer made of zinc alloy and a tin layer made of tin alloy layered on the substrate in this order, wherein the whole of the zinc layer and the tin layer consists of zinc, tin and, optionally, one or more additive elements selected from the group consisting of nickel, iron, manganese, molybdenum, cobalt, cadmium and lead, wherein in the zinc layer and the tin layer, an adhesion amount of tin contained in the whole of the zinc layer and the tin layer is not less than 0.5 mg/cm$^2$ and not more than 7.0 mg/cm$^2$, an adhesion amount of zinc contained in the whole of the zinc layer and the tin layer is not less than 0.07 mg/cm$^2$ and not more than 2.0 mg/cm$^2$, and a zinc content percentage in a vicinity of a surface of the zinc layer which is not in contact with the tin layer or a surface of the tin layer which is not in contact with the zinc layer is not less than 0.2% by mass and not more than 10% by mass, and wherein at least one of the tin layer and the zinc layer contains an adhesion amount of an additive element other than zinc and tin, wherein the adhesion amount contained in the whole of the zinc layer and the tin layer is not less than 0.01 mg/cm$^2$ and not more than 0.3 mg/cm$^2$, and wherein the additive element consists of one or more of nickel, iron, manganese, molybdenum, cobalt, cadmium and lead.

2. The terminal material for connectors according to claim 1, wherein a corrosion potential to a silver-silver chloride electrode is not more than −500 mV and not less than −900 mV.

3. The terminal material for connectors according to claim 1, wherein the adhesion amount of the zinc is not less than one times and not more than 10 times of the adhesion amount of the additive element.

4. The terminal material for connectors according to claim 1, further comprising a ground layer made of nickel or nickel alloy formed between the substrate and the zinc layer, wherein the ground layer has a thickness not less than 0.1 um and not more than 5 um and a nickel content percentage not less than 80% by mass.

5. The terminal material for connectors according to claim 1, wherein the terminal material is a strip material comprising terminal members coupled to a carrier part with intervals along a length direction of the carrier part.

6. A terminal formed from the terminal material for connectors according to claim 1.

7. An electric wire termination structure wherein the terminal according to claim 6 is crimped to a terminal end of an electric wire made of aluminum or aluminum alloy.

* * * * *